US005660442A

United States Patent [19]

Tornero

[11] Patent Number: 5,660,442

[45] Date of Patent: Aug. 26, 1997

[54] ADJUSMENT DEVICE FOR CHAIR ARMS

[76] Inventor: Lino E. Tornero, 809 Quailmeadow La., Colfax, N.C. 27235

[21] Appl. No.: 556,461

[22] Filed: Nov. 13, 1995

Related U.S. Application Data

[63] Continuation-in-part of Ser. No. 289,578, Aug. 15, 1994, Pat. No. 5,586,811.

[51] Int. Cl.[6] ..... A47C 7/54

[52] U.S. Cl. ..... 297/411.36; 297/411.37; 248/297.21; 248/118; 403/373

[58] Field of Search ..... 297/411.36, 411.37, 297/411.35; 248/118, 118.3, 118.5, 297.21, 297.11, 298.1; 403/373, 362, 363, 375, 377

[56] References Cited

U.S. PATENT DOCUMENTS

| | | | |
|---|---|---|---|
| 1,711,158 | 4/1929 | Rece | 248/297.21 X |
| 2,256,944 | 9/1941 | Tall | 297/411.36 X |
| 2,773,544 | 12/1956 | Dusenbury | 297/411.37 X |
| 4,568,050 | 2/1986 | Radoy et al. | 248/297.21 X |
| 4,815,688 | 3/1989 | Wood | 297/411.37 X |

*Primary Examiner*—Laurie K. Cranmer

[57] ABSTRACT

An adjustment device for chair arms and the like allows releasable adjustment by the user without the necessity of tools or levers. A mounting member is provided with an elongated slot for engaging and limiting the travel of guide posts which are affixed to a structural member. The adjustment device is generally attached to the underside of a chair seat and includes disk-shaped springs which provide sufficient compression to allow manual movement yet maintain the selected position when the manual force is terminated.

17 Claims, 6 Drawing Sheets

ADJUSMENT DEVICE FOR CHAIR ARMS

This is a continuation-in-part of patent application Ser. No. 08/289,578 of the inventor filed 15th Aug. 1994 now U.S. Pat. No. 5,586,811.

FIELD OF THE INVENTION

The invention herein pertains to slidable adjustment devices and particularly to adjustment devices for furniture such as for chair arms as may be releasably adjusted without need of manual actuating levers.

BACKGROUND AND OBJECTS OF THE INVENTION

The present invention relates in general to devices which provide for the selective adjustment and positioning of movable structural components relative to one another. As will be seen, the device is ideally suited for use in furniture, particularly office furniture, where the current market emphasis on ergonomic design calls for adjustable furniture structures such as used with certain chairs that can be adjustably positioned to fit different individuals with various heights, weights and job tasks.

Primarily the device is intended for the positioning of components where frictional locking is sufficient and load forces moderate, such as with chair arms, but where it is desirable to avoid the use of friction inducing levers or other locking members. The adjustment device herein can be used to laterally position the arms of a chair to accommodate users of different body widths. In the prior art, chair arm lateral adjustment has been accomplished by means of structural members or "J- BARS" provided with elongated slots and bolted to the undercarriage or seat pan of the chair. One type of adjustment was accomplished by reaching under the chair with a specialized tool or wrench and loosening or tightening several bolts. Another type of adjustment, such as is the subject of my U.S. Pat. No. 5,338,133, for loosening or tightening by means of a lever which frictionally locks in one position or another. While the latter method was practical and effective it has the disadvantage of the presence of the actuating lever that tends to clutter the underside of the chair seat, where one already finds numerous levers pertaining to the adjustment of other adjustment devices on the chair. It has been found, that chair arms are normally subject to stress loads (such as by the occupant's arms), in any position of lateral adjustment, perpendicular to the chair seat. Little or no horizontal loads act on the chair arms. Therefore, it is felt that it would be possible and highly desirable to obtain positioning of the chair arms without the need for a "locking" function, and that all that is needed is the ability to laterally adjust the position of the arms and provide only a simple "detente" in any of several arbitrarily chosen positions, thus eliminating the need for a "locking lever". Alternately, where a "detente" is not required or may prove costly, the adjustment device may include only a frictional adjustment. The device and objective of the present invention provides for quick manual positioning of one structural member relative to another. In particular, where office chairs are concerned, the device may serve to laterally position chair arms relative to the chair seat at any of an arbitrarily chosen number of positions within a predetermined range (sometimes referred to as the "Stroke"), or, in the alternate method, at any of an infinite number of positions within the predetermined range (Stroke). It will appear clear from the subsequent specification that the device is not limited to use in chairs and articles of furniture but has many uses where reliable and economical structural adjustment is sought.

SUMMARY OF THE INVENTION

In a chair, one form of the adjustment device comprises a bushing in sliding contact with the structural member. The bushings are maintained in sliding contact with the structural member of the chair arm by encasement within a support member and a retaining member. Two guide posts are installed through holes in the retaining member, in sliding contact through the elongated slot in the structural member and are fixedly attached to the support member. A number of spring washers are inserted around the guide posts, between the retaining member and one half of the bushing, to provide constant pressure of the bushing around the structural member. The support member, bushing and structural member assembly is held together and mounted to the underside of a chair by means of screws or bolts inserted through peripheral mounting holes provided on the support member and matching similar holes on the retaining member. In this manner the structural member is free to slide the length of the elongated slot while held snugly within the bushing, the support member and the retaining member. The structural member is provided with blind holes arbitrarily spaced from one another and the elongated slot. The bushing is provided with a hole so that movement of the structural member within the bushing causes the hole in the bushing to selectively and concentrically align with the holes in the structural member. The support member is provided with a hole in concentric alignment with the hole in the bushing, and axially aligned with a hole provided for the attachment of one of the guide posts. A detente member is inserted through the hole in the mounting member and the bushing so as to selectively seat within the blind hole on the structural member responsive to movement of the structural member. To insure that the detente member seats properly on the blind hole of the structural member, a flat spring is provided to maintain normal pressure on the detente member and is fitted with a hole for attachment to the threaded portion of the guide post by means of a nut. Thus, as the structural member slides relative to the bushing, support member and retaining member, the detente member partially descends into the blind hole(s) on the structural member, responsive to pressure from the flat spring providing for a "detente" position at each of the blind holes. Thus, the chair occupant need only apply moderate force normal to the structural member to obtain desired lateral positioning of the arm relative to the chair.

A second form of the adjustment device comprises a structural member provided with guide posts, in normally constant yet adjustable compression with a mounting member. The mounting member is provided with an elongated slot for slidably engaging and limiting the travel of the guide posts and therefore of the structural member relative to the mounting member, and is provided also with means for attaching to the underside of the chair seat.

At one end one or both guide posts may concentrically include a spring member, in contact with the mounting member, and at the other end, said guide posts are provided with retaining members, which may be of a threaded type, so as to provide an adjustable amount of compression to the spring member and thus vary the compression force and friction between the structural member and the mounting member in order to achieve a firm yet slidable engagement thereof.

The device allows for the positional adjustment of the structural member relative to the mounting member in firm yet slidable engagement responsive to an external force applied to the structural member, such as a chair arm "upright", and the amount of force required can be advantageously selected depending on the compression force applied to the spring members by the adjustment of the retaining members on the guide posts.

The advantages of the device are numerous since it is possible for the chair occupant to remain seated while adjusting the lateral positions of the chair arms which can be accomplished without the use of specialized tools, built-in levers, or help from maintenance crews. Furthermore, the device is simple to manufacture, install and conceal under the chair where it does not interfere with normal use of the chair.

BRIEF DESCRIPTION OF DRAWINGS

In order to better understand the features of the invention the following drawings have been provided.

DETAILED DESCRIPTION OF THE DRAWINGS AND OPERATION OF THE INVENTION

Figure 2:
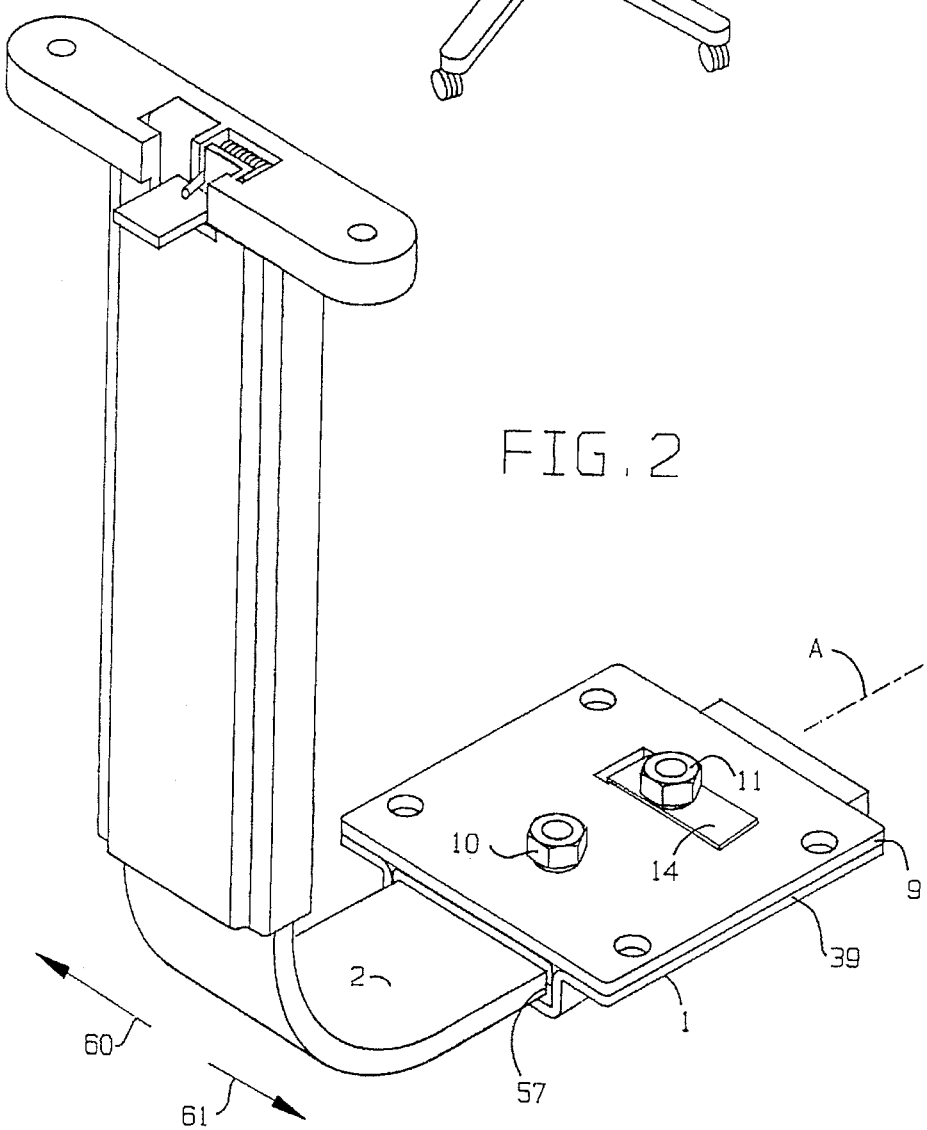
FIG. 2 is a detailed perspective view of the adjustable arm shown in FIG. 1 and includes the preferred form of the adjustment device.
Figure 3:
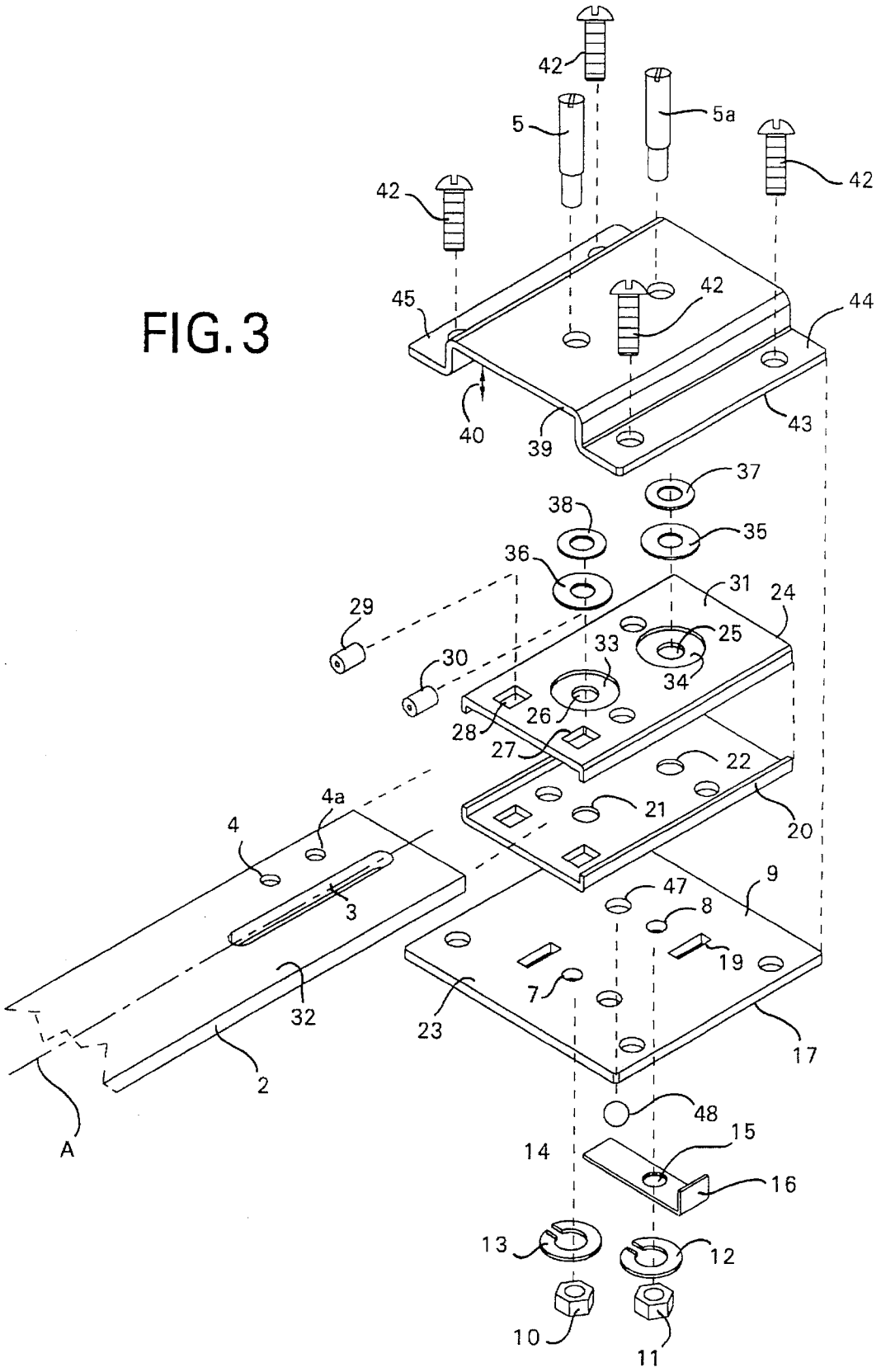
FIG. 3 is an exploded inverted view of the preferred form of the adjustment device and a partial view of the structural member.

The object of the invention can be achieved in an advantageous manner by the arrangement of the members shown in the accompanying drawings of which the following are detailed descriptions:

Referring to FIGS. 2 and 3, an exploded view of the preferred form of adjustment device 1 is shown in FIG. 3 comprising structural member 2 provided with an elongated slot 3 for sliding guidance about guide posts 5 and 5*a*. Threaded portion 6 of said guide posts 5 and 5*a* is inserted through holes 7 and 8 of support member 9 and are threadably attached to support member 9 by means of nuts 10 and 11 and lock washers 12 and 13. Spring 14 is provided with a hole 15 and a flange 16. Spring 14 is inserted on threaded portion 6 guide post 5*a* so that spring 14 is flat against the surface 17 of support member 9 and is retained thereagainst by lock washer 12 and nut 11. Flange 16 of spring 14 is located within the cavity 19 so as to insure correct and permanent orientation of spring 16 relative to support member 9. First bushing half 20 is inserted so as to engage guide posts 5 and 5*a* through holes 21 and 22 on first bushing 20, and is in flat contact with surface 23 of support member 9. Steel detente member 48 is inserted in hole 46 of first bushing half 20 and hole 47 of support member 9 and is prevented from movement beyond the support member 9 by spring 14. Structural member 2 is inserted flat against first bushing half 20 so that slot 3 slidably engages guide posts 5 and 5*a* and holes 4 and 4*a* are able to engage detente member 48 responsive to axial displacement of chair structural member 2. Second bushing half 24 is inserted flat against said structural member 2 so that holes 25 and 26 engage said guide posts 5 and 5*a*. Second bushing half 24 is provided with cavities 27 and 28 to receive friction members 29 and 30. Friction members 29 and 30 are normally chosen to be of a flexible material resistant to abrasion and their size is chosen to be such that a certain percentage of said friction members 29 and 30 remains above the upper surface 31 of second bushing 24 when said friction members lie within cavities 27 and 28 and in contact with surface 32 of structural member 2. Two blind cavities 33 and 34 are located concentric with holes 25 and 26 of the second bushing 24 to receive washers 35 and 36. Washers 35 and 38 provide stiff support for spring discs 37 and 38. Retaining member 39 is shaped so as to provide encasement of first bushing half 20, structural member 2, second bushing half 24, friction members 29 and 30, washers 35 and 36, and spring discs 37 and 38. Retaining member 39 is provided with throat depth 40 so that when retaining member 39 is attached to underside 41*a* of a chair 41 by means of bolts 42, the surfaces 43 of flanges 44 and 45 are in firm contact with the surface 23 of support member 9, the spring discs 38 and 37 are in compression and friction members 29 and 30 are slightly deformed by compression.

Figure 4:
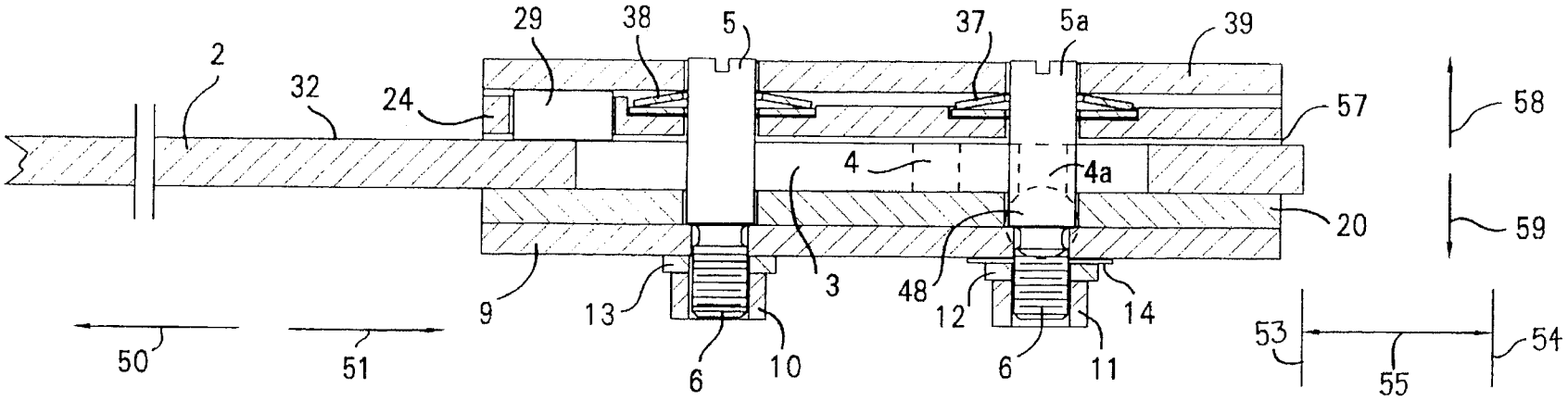
FIG. 4 is a cross section of the preferred form of the device along axis A of FIG. 2 and shows the device in one position.

Referring now to FIG. 4 it can be seen that structural member 2 is maintained in snug but sliding fit at all times relative to directions 58 and 59 and within the cavity 57 formed by bushings 20 and 24 due to the pressure exerted by springs 38 and 37 while in compression between retaining member 39 and support member 9.

Referring now to FIG. 2 and FIG. 3, it can be seen that structural member 2 is maintained in snug but sliding fit relative to directions 60 and 61 and within the cavity 57 formed by bushing halves 20 and 24 due to the sliding fit maintained by the engagement of guide posts 5 and 5*a* within slot 3 of the structural member 2.

Figure 1:
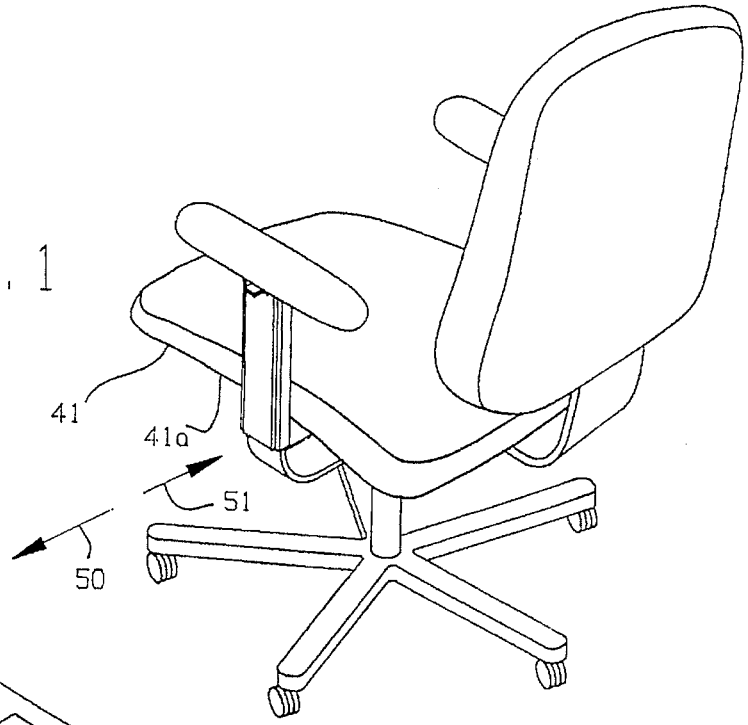
FIG. 1 is a perspective view of a typical office chair shown with arms installed.
Figure 5:
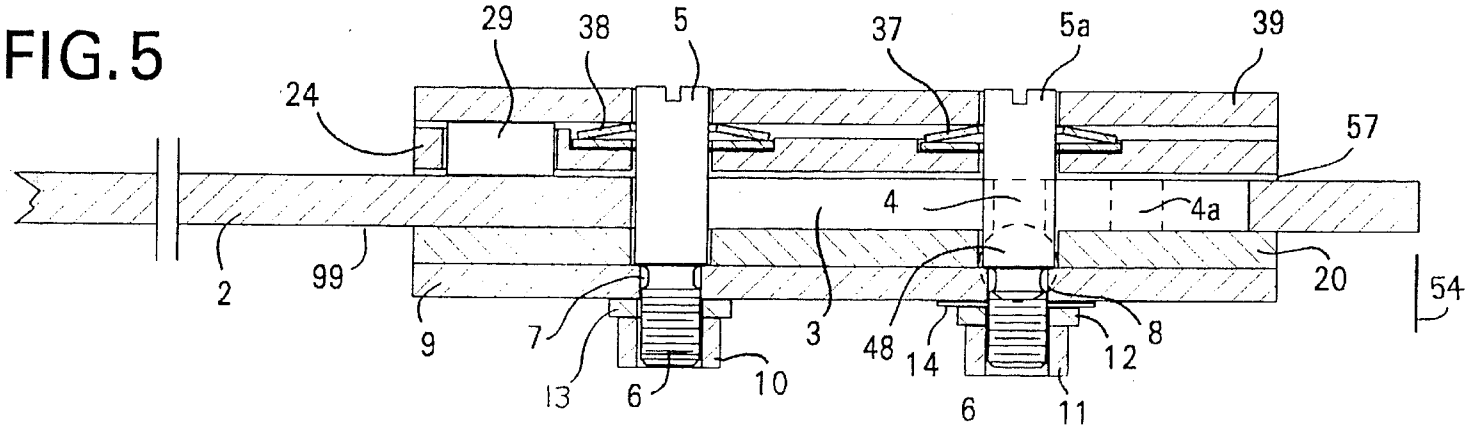
FIG. 5 is a cross-section of the preferred form of the device along axis A of FIG. 2 and shows the device in yet another position.

Referring now also to FIG. 1, FIG. 4 and FIG. 5, operation of the adjustment device 1 is accomplished by manually displacing structural member 2 in a direction responsive to forces 50 or 51 so as to cause structural member 2 to move from a first position 53 to a second position 54. While structural member 2 is in first position 53 detente member 48 is seated on hole 4*a* of structural member 2 due to the force exerted on detente member 48 by spring 14. When force 51 is exerted upon structural member 2 which is sufficient to overcome the resistance offered by the detente member 48 and spring 14, structural member 2 is able to displace a distance 55 in the direction of applied force 51 so that detente member 48 is pushed against spring 14 and will seat momentarily on surface 99 of structural member 2. When responsive to said force 51, said chair structural member 2 reaches position 54, and hole 4 is directly above the detente member 48, spring 14 will cause the detente member to seat in hole 4 providing a detente effect detectable by the chair user. Reverse operation is analogous when a force 50 is applied to structural member 2.

Figure 6:
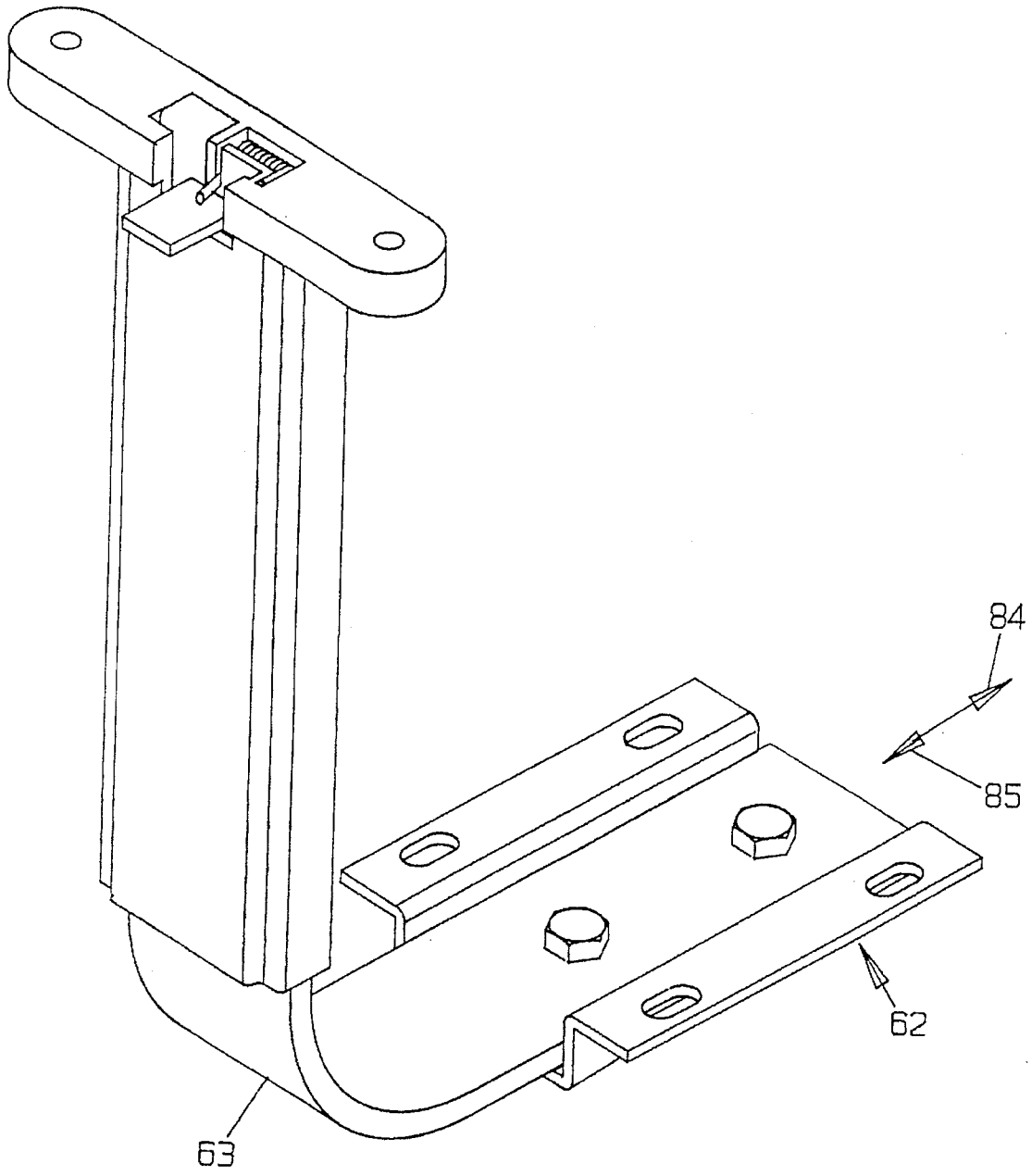
FIG. 6 is a detail perspective view of a part of the adjustable arm shown with arms installed with a second or alternative form of the adjustment device.
Figure 7:
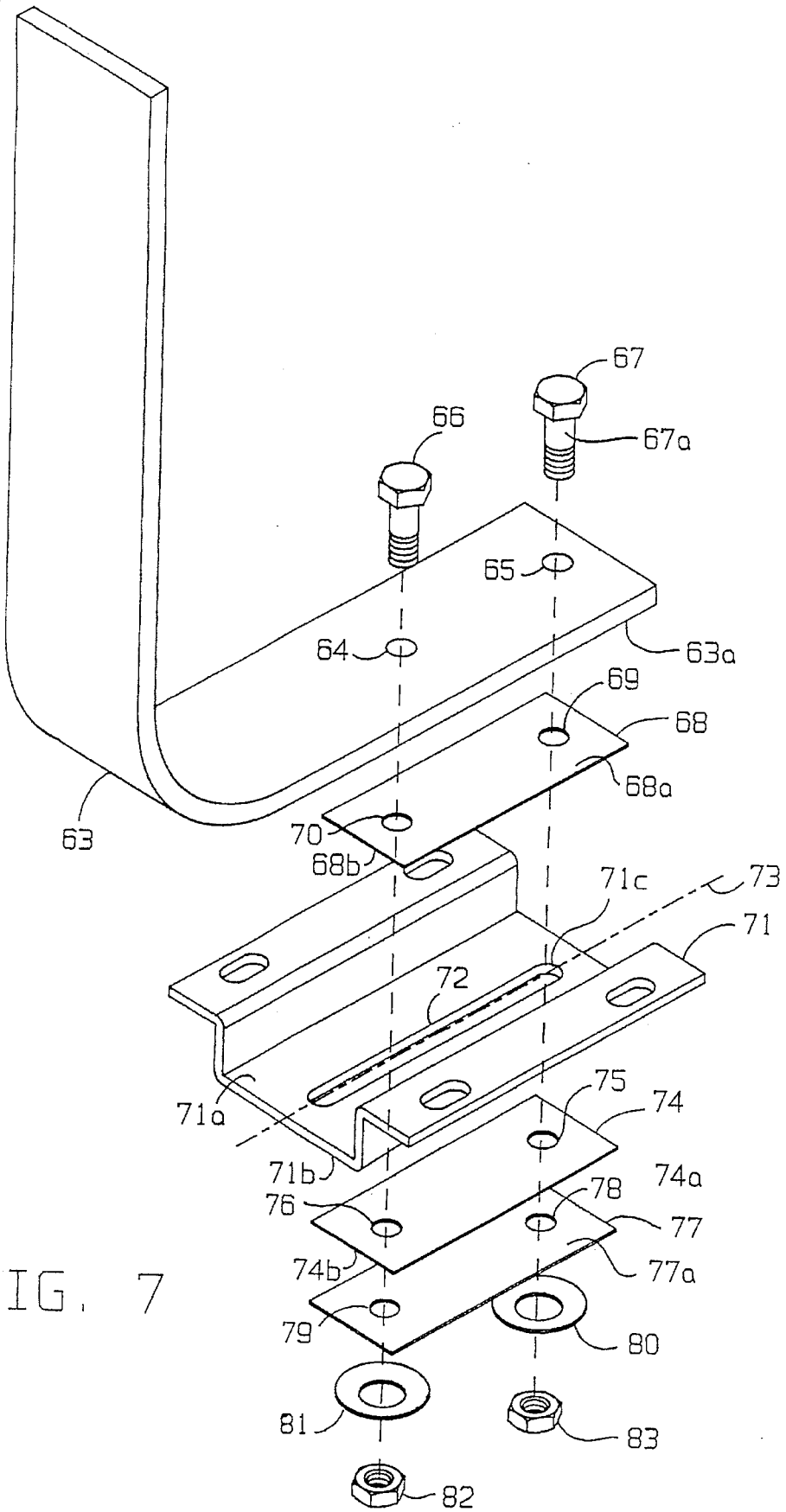
FIG. 7 is an exploded inverted view of the alternative form of the adjustment device and a partial view of the structural member.
Figure 8:
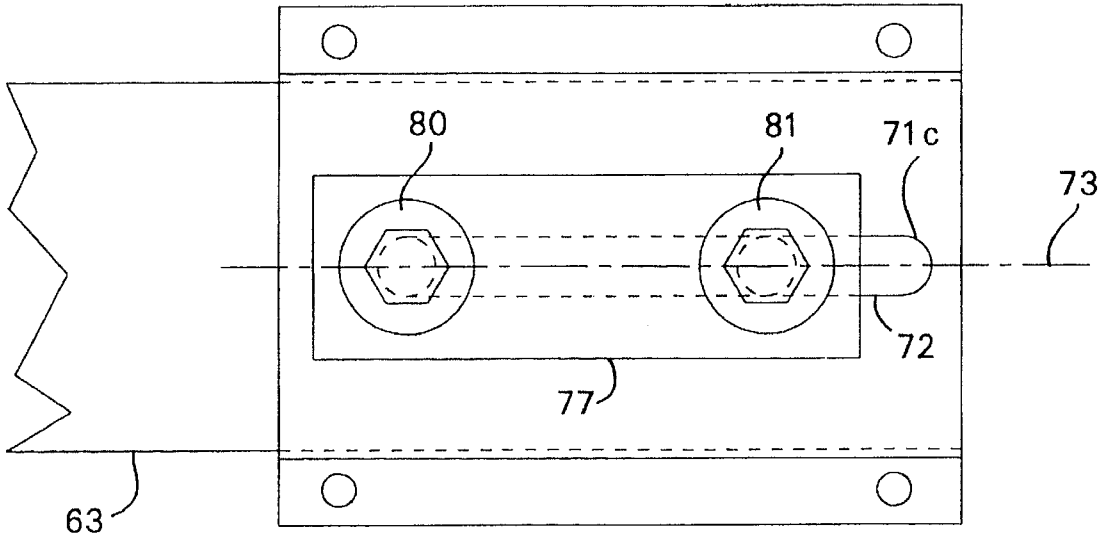
FIG. 8 is a top view of the alternative form of the device.

Referring to FIGS. 5, 6 and 7, an exploded view of an alternative form of the device 62 is shown comprising structural member 63 provided with two holes 64 and 65 for receiving posts 66 and 67. A friction reducing plate 68 may be included, so that its upper surface 68*a* is in sliding contact with the lower surface 63*a* of structural member 63. Friction reducing plate 68 is aligned so that holes 69 and 70 are in concentric engagement with posts 66 and 67. A mounting member 71 is provided with an elongated slot 72 along its central axis 73 for slidable engagement with posts 66 and 67. Mounting member 71 is positioned so that its inner surface 71*a* is in slidable contact with the lower surface 68*b* of friction reducing plate 68. Yet another friction reducing plate 74 may be included so that holes 75 and 76 are in concentric engagement with posts 66 and 67 and the upper surface 74*a* is in slidable contact with the lower surface 71*b* of mounting member 71. A pressure plate 77 is provided with holes 78 and 79 for concentric engagement with posts 66 and 67 and its upper surface 77*a* is in contact with the lower surface 74*b* of friction reducing plate 74. Springs 80 and 81 are in concentric engagement with posts 66 and 67 and are retained next to said pressure plate 77 by means of retaining members 82 and 83 which may be of the type commonly known as lock-nuts.

Figure 9:
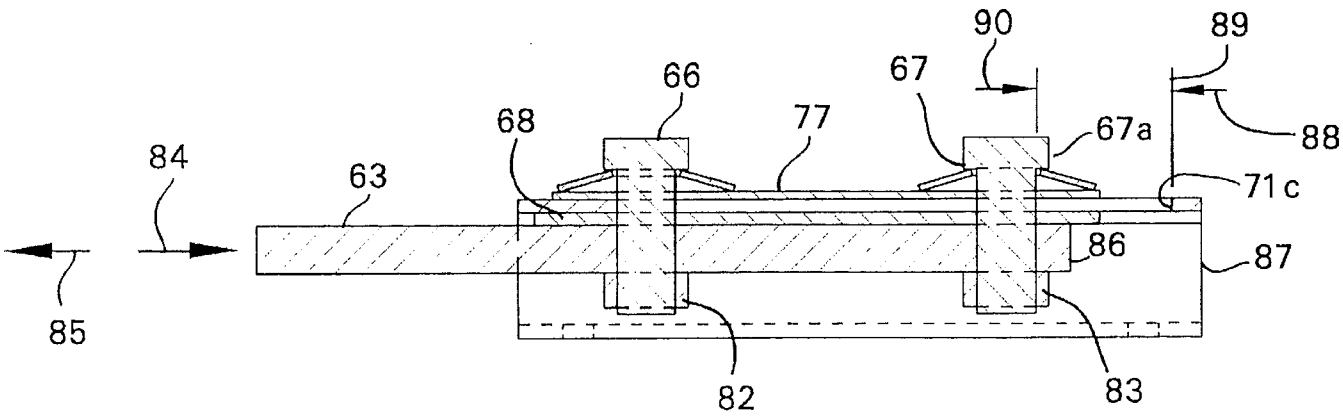
FIG. 9 is a cross-section of the of the alternative form of the adjustment device along axis 73 of FIG. 7 showing the device in one position.

Referring now to FIG. 9, device 62 is shown assembled so that structural member 63, posts 66 and 67, friction reducing plate 68, friction reducing plate 74, pressure plate 77, springs 80 and 81 and retaining members 82 and 83, are able to slidably move relative to said mounting member 71 an arbitrarily chosen distance 88 from one position 90 described by the body 67*a* of post 67, to another position 89 described by end 71*c* of slot 72 in mounting member 71, and responsive to a force 84 applied to structural member 63 for movement in one direction or to a force 85 for movement in another direction. Mounting plate 71 is firmly fastened to the lower surface 41A of a chair 41.

Operation of the adjustment device is accomplished by manually displacing structural member 63 in a direction responsive to forces 85 or 84 so as to cause structural member 63 to move from first position 86 to second position 87 or to any of an infinite number of positions along 88.

It is to be understood that the device is not limited to use in chairs, it being adaptable for use where it is necessary to releasably adjust the displacement of one member relative to another member. It will be apparent that many useful modifications of the device are possible without departing from the fundamental basis of the invention and the illustrations and examples provided herein are for explanatory purposes only and are not intended to limit the scope of the appended claims.

I claim:

1. An adjustment device comprising: a structural member, a mounting member slidably engaging said structural member, said mounting member defining an elongated slot, means for restricting movement of said structural member relative to said mounting member, said movement restricting means located within said elongated slot, and a friction reducing plate, said friction reducing plate positioned proximate said mounting member, a pressure plate positioned proximate said mounting member, said pressure plate defining an aperture, said movement restricting means positioned in said aperture and further comprising a second friction reducing plate positioned proximate said mounting member.

2. The adjustment device of claim 1, further comprising means for preventing said mounting member from escaping engagement with said structural member.

3. The adjustment device of claim 1, wherein said restricting means comprises a post for slidably engaging said structural member and said elongated slot of said mounting member.

4. The adjustment device of claim 3, wherein said restricting means comprises a retaining member engaged with said post for retaining said mounting member proximate to said structural member.

5. The adjustment device of claim 3, wherein said elongated slot is wider than said post.

6. The adjustment device of claim 3, wherein said post is cylindrically shaped.

7. The adjustment device of claim 3, wherein said post is fixed relative to said structural member.

8. The adjustment device of claim 1, further comprising means for maintaining said structural member and said mounting member in slidable engagement under compression.

9. The adjustment device of claim 8, wherein said maintaining means comprises a spring.

10. The adjustment device of claim 9, wherein said spring is disk shaped.

11. A furniture adjustment device, comprising:

(a) a structural member, said structural member defining an aperture, said structural member for supporting a first furniture component;

(b) a mounting member positioned proximate said structural member, said mounting member defining an elongated slot, said mounting member for attachment to a second furniture component;

(c) a pressure plate positioned proximate said mounting member, said pressure plate defining an aperture;

(d) a post positioned in said structural member aperture and in said pressure plate aperture, said post slidably carried within the elongated slot of said retaining member;

(e) a spring positioned proximate said pressure plate, said spring for urging said pressure plate toward said mounting member to place said mounting member and said structural member under spring pressure;

(f) a first friction reducing plate positioned proximate said pressure plate; and (g) a second friction reducing plate positioned proximate said pressure plate;

whereby the first furniture component is slidably adjustable relative to the second furniture component by overcoming the spring pressure applied to said structural member and said mounting member by said pressure plate.

12. The device of claim 11, wherein said first friction reducing plate is positioned between said pressure plate and said mounting member.

13. The device of claim 11, wherein said first friction reducing plate defines an aperture with said post positioned therein.

14. The device of claim 11, wherein said second friction reducing plate is positioned between said structural member and said mounting member.

15. The device of claim 11, wherein said spring defines an aperture with said post positioned therein.

16. The device of claim 11, further comprising a second post, said structural member defining a second aperture, and said second post positioned in said second aperture of said structural member.

17. A furniture adjustment device, comprising:

(a) a structural member, said structural member defining an aperture, said structural member for supporting a first furniture component;

(b) a mounting member positioned proximate said structural member, said mounting member defining an elongated slot, said mounting member for attaching to a second furniture component;

(c) a pressure plate positioned proximate said mounting member, said pressure plate defining an aperture;

(d) a spring positioned proximate said pressure plate, said spring defining an aperture, said spring for urging said pressure plate toward said mounting member to place said structural member and said mounting member under spring pressure;

(e) a first friction reducing plate positioned between said pressure plate and said mounting member, said first friction reducing plate defining an aperture;

(f) a second friction reducing plate positioned between said structural member and said mounting member, said second friction reducing plate defining an aperture;

(g) a post positioned in said structural member aperture, in said pressure plate aperture, in said spring aperture, and in said first and said second friction reducing member apertures, said post slidably carried within said elongated slot of said retaining member; and (h) a retaining member joined to said post, said retaining member in contact with said spring;

whereby the first furniture component is slidably adjustable relative to the second furniture component by overcoming the spring pressure applied to said structural member and said mounting member by said pressure plate.

* * * * *